US010286685B2

(12) United States Patent
Toles et al.

(10) Patent No.: US 10,286,685 B2
(45) Date of Patent: May 14, 2019

(54) PRINT PRE-TREATMENT MODULE

(71) Applicant: Hewlett-Packard Development Company, L.P., Houston, TX (US)

(72) Inventors: Christopher Arend Toles, Escondido, CA (US); Joan Albert Jorba Closa, Sant Cugat de Valles (ES); Ronald Albert Askeland, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/741,241

(22) PCT Filed: Sep. 15, 2015

(86) PCT No.: PCT/US2015/050200
§ 371 (c)(1),
(2) Date: Dec. 29, 2017

(87) PCT Pub. No.: WO2017/048237
PCT Pub. Date: Mar. 23, 2017

(65) Prior Publication Data
US 2018/0186157 A1 Jul. 5, 2018

(51) Int. Cl.
*B41J 11/00* (2006.01)
*B41M 5/00* (2006.01)
*B41J 3/407* (2006.01)

(52) U.S. Cl.
CPC ..... *B41J 11/0015* (2013.01); *B41J 3/407* (2013.01); *B41M 5/0011* (2013.01); *B41M 5/0047* (2013.01); *B41M 5/0064* (2013.01)

(58) Field of Classification Search
CPC ..... B41J 29/17; B08B 7/0028; H04N 1/00; H04N 1/00909; G03G 15/65
USPC ..... 347/101, 105, 106
See application file for complete search history.

(56) References Cited

U.S. PATENT DOCUMENTS

| | | | | |
|---|---|---|---|---|
| 6,001,472 | A | 12/1999 | Ikeda et al. | |
| 8,382,946 | B2 | 2/2013 | Song et al. | |
| 10,119,042 | B2 * | 11/2018 | Kido | C09D 11/322 |
| 2009/0041505 | A1 | 2/2009 | Tomita | |

(Continued)

FOREIGN PATENT DOCUMENTS

| | | |
|---|---|---|
| EP | 0475424 | 3/1992 |
| GB | 1572345 | 7/1980 |
| JP | H09295419 | 11/1997 |

(Continued)

OTHER PUBLICATIONS

Asadinezhad, Ahmad, et al., Recent Progress in Surface Modificaiton of Polyvinyl Chloride, Materials 2012, 5, 2937-2959, Dec. 18, 2012, 23 pages.

(Continued)

*Primary Examiner* — An H Do
(74) *Attorney, Agent, or Firm* — Dierker & Kavanaugh PC

(57) ABSTRACT

A print pre-treatment module is provided for printing an ink on a PVC print medium from a printer. The PVC print medium may have exudates on the surface. The pre-treatment module includes an impermeable material in rubbing contact with the PVC print medium, which is supported on a media roller conveying the print medium. Also disclosed herein are a printer incorporating the module and a method for reducing print defects on the PVC print medium.

16 Claims, 3 Drawing Sheets

(56) References Cited

U.S. PATENT DOCUMENTS

| | | | |
|---|---|---|---|
| 2013/0169724 | A1 | 7/2013 | Gotou |
| 2013/0201268 | A1 | 8/2013 | Zhou et al. |

FOREIGN PATENT DOCUMENTS

| | | |
|---|---|---|
| JP | 2000033749 | 2/2002 |
| WO | WO99/33669 | 7/1999 |

OTHER PUBLICATIONS

International Search Report and Written Opinion for International Application No. PCT/US2015/050200 dated May 25, 2016, 13 pages.

Zhongyi Ink & Paint Co., Ltd., Technical Guidelines for use solvent-based inks: Plastic Screen Printing, http://www.zhongyi-ink.com/en/helpcenter/154-689.html, Aug. 6, 2013, 5 pages.

* cited by examiner

PRINT PRE-TREATMENT MODULE

BACKGROUND

Inkjet technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of media substrates. These printable media or recording material can be cut sized sheets or commercial large format media such as banners and wallpapers. Current inkjet printing technology involves forcing the ink drops through small nozzles by thermal ejection, piezoelectric pressure or oscillation, onto the surface of such media. Within the printing method, the media substrate plays a key role in the overall image quality and permanence of the printed images.

Nowadays, there is a growing demand for digitally printed contents which is no longer limited to the "traditional" black-white text images and full color photo images, but extends also to prints with visual special effects such as the metallic appearance and/or reflectivity, for example. Accordingly, investigations continue into developing media and/or printing methods that can be effectively used with such printing techniques, which imparts good image quality and which allow the production of specific appearances.

Some printing media may contain substances which over time may migrate to the printing surface. This phenomenon may occur for instance when rolled media is exposed to high temperatures, for example, during transportation or storage, or simply when media is stored for some time before use.

For example, print media such as vinyl and PVC banners may contain plasticizers to increase their flexibility, and these additives may tend to migrate to the surface as non-uniform exudates. Other substances that may exhibit a tendency to migrate to the printing surface may be, for example, adhesives or silicones present in adhesive media.

BRIEF DESCRIPTION OF THE DRAWINGS

The accompanying drawings illustrate various examples of the principles described herein and are a part of the specification. The illustrated examples do not limit the scope of the claims.

DETAILED DESCRIPTION

Figure 1:
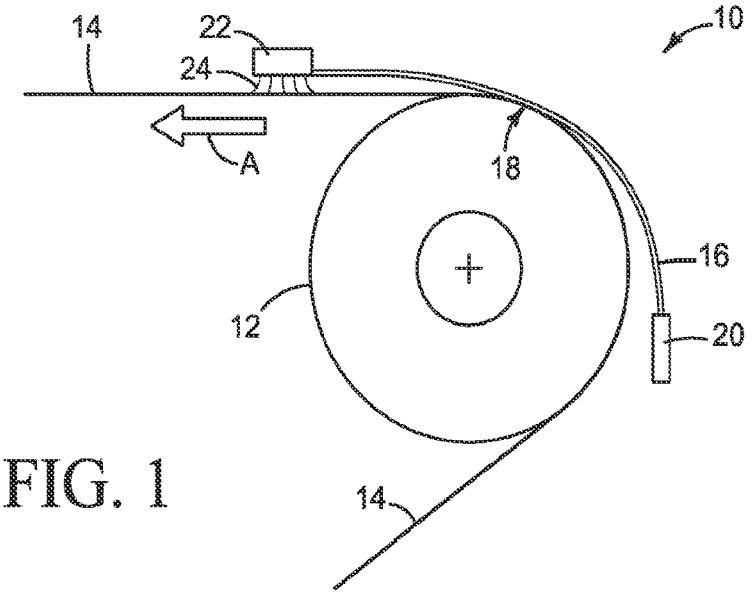
FIG. 1 is a cross-sectional view of a first print pre-treatment module for print media printed on printers, according to an example.

Before particular examples of the present disclosure are disclosed and described, it is to be understood that the present disclosure is not limited to the particular process and materials disclosed herein. It is also to be understood that the terminology used herein is used for describing particular examples only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Thus, for example, reference to "a particle" includes reference to one or more of such materials.

The presence in some printing media of substances, such as plasticizers or adhesives, which over time may migrate to the printing surface forming micro-droplets or random patterns, or non-uniform exudates, may affect the quality of printed images. Exudates may be considered to be components that bloom to the surface in a non-uniform pattern. These print defects may give a mottled appearance to the ink and may be seen as speckles in the printed image. Example print systems exhibiting this defect are aqueous latex and eco-solvent inks printing on some PVC print media, such as those stored for a long period of time or exposed to high temperature or humidity.

In implementations disclosed herein, the quality of the printed image may be improved by rubbing the printing surface of the print medium before printing, so as to spread over a larger surface area, i.e. more evenly, substances that may be present on the surface in the form of non-uniform exudates.

The present disclosure describes a print pre-treatment module for printing an ink on a polyvinyl chloride (PVC) print medium from a printer, in which the PVC print medium has exudates on the surface. In an example, the exudates may be non-uniform. Also in an example, the ink may be a latex ink or an eco-solvent ink. The pre-treatment module may include an impermeable material in rubbing contact with the PVC print medium, which may be supported on a media roller conveying the PVC media. By "impermeable" is meant impermeable, or impervious, to the exudates, such as phthalates and other plasticizers that may be employed in the manufacture of the PVC print medium. Essentially, the impermeable material may be an impervious material, such as a non-woven polymer sheet. Such non-woven polymer sheets are smooth, solid materials, without voids, such as may be present in polyester microfiber, suede, and foam rubber materials.

One example of an impermeable material that may be suitably employed in the practice of the teachings herein is PVC or other vinyl material. Other examples may include low density polyethylene film (LDPE), high density polyethylene film (HDPE), and polyethylene terephthalate film (PET). By "rubbing contact" is meant that the impermeable material exerts sufficient pressure against the PVC print medium so as to "smear" the exudates, e.g., plasticizers, around the surface of the print medium and substantially homogenize the surface energy.

Latex inks can be considered as a subcategory of aqueous inks and use water as the primary solvent or carrier of resin and colorant. The vehicle may also contain a small amount of a co-solvent. In latex inks, this co-solvent may also function to soften target plastic print media such as vinyl. The colorant used in latex inks may be a pigment that provides the light fastness required in signage applications. The resin used in latex inks may be a latex polymer, which may be formed by polymerizing a monomer such as styrene that has been emulsified with surfactants. The latex polymer may be stabilized to reduce settling in an aqueous environment.

A solvent ink is one that may contain a large majority of organic solvent. It may be simpler than an aqueous ink, as the solvent may perform the functions of a carrier fluid for the colorant and resin, wetter of the print media, and drying aid. The solvent initially may wet and soften the substrate before evaporating. Solvent inks may use a dye or a pigment as the colorant, although solvent inks designed for outdoor applications more commonly may use pigments. An eco-solvent ink may have little or no odor and does not contain any harmful ingredients (such as cyclohexanone). The solvents within eco-solvent inks may be biodegradable and may be able to be broken down within the human body.

In a first example, the print pre-treatment module may include the impermeable material draped over the media roller and maintained in tension to form a drape in rubbing contact. FIG. 1 depicts a first example of the pre-treatment module 10. In this example, a media roll 12 conveys a print medium, e.g., PVC, 14 in the direction shown by arrow A. Impermeable material 16 hangs down over the media roll 12, and may be maintained in rubbing contact at contact region 18 with the print medium 14.

The contact region 18 may be a relatively narrow contact zone, with the zone extending across the surface of the media roll 12. It does not appear that attempting to control the length of the contact region 18 results in better or worse smearing, other than that the length of the contact region 18 should be sufficient to cause smearing of the plasticizers and not so great as to impede the flow of the print medium 14 or to heat it. Simple experimentation may determine the appropriate length of the contact region 18.

In an example, a weight 20 may be used to provide and maintain the requisite tension to ensure that the impermeable material 16 may be in rubbing contact with the print medium 14. The weight 20 may not be so heavy as to impede the flow of the print medium 14 or to heat it and may not be so light as to avoid smearing the plasticizers around the print medium 14. Simple experimentation may be used to determine the appropriate weight for a given set of conditions.

In another example, a spring mechanism 20 may be used to provide and maintain the requisite tension to ensure that the impermeable material 16 is in rubbing contact with the print medium 14. The same considerations for determining the appropriate weight 20 also may be used to determine the appropriate spring tension of the spring mechanism 20.

Alternatively, the spring mechanism 20 may be an adjustable or regulated spring mechanism that may be used in order to adapt the pre-treatment module to the different rubbing characteristics that each media would require. An example of a regulated spring mechanism may be a spring that is attached from one side to the rubbing material and to a screw on the other side. The force may be adjusted by loosening and tightening the screw.

A static dissipation device 22 may be used to reduce or eliminate any static from the surface of the print medium 14 created by the rubbing contact. Examples of suitable static dissipation devices include an anti-static tinsel or anti-static brush 24. Such static dissipation devices are available commercially and typically include metal or carbon fibers as the tinsel or brush 24.

In a second example, the pre-treatment module 10 may include the impermeable material 16 wrapped around a spindle 26, which is free to counter-rotate against the print media, e.g., PVC, 14 in rubbing contact. The pressure exerted by the spindle 26 may not be so great as to impede the flow of the print medium 14 or to heat it and may not be so light as to avoid smearing the plasticizers around the print medium 14. Simple experimentation may be used to determine the appropriate pressure for a given set of conditions.

Figure 2:
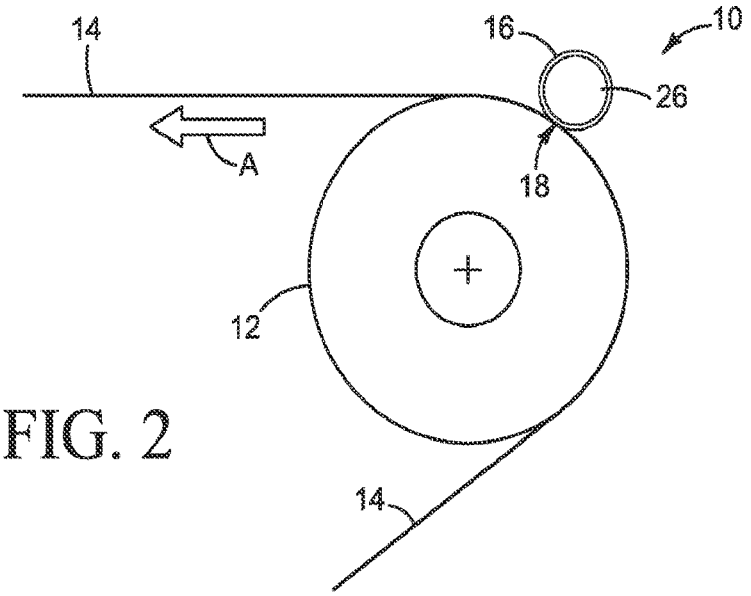
FIG. 2 is a cross-sectional view of a second print pre-treatment module for print media printed on printers, according to an example.

The same considerations for determining the length of the contact region 18 in the first example may be used here as well. Further, the static dissipation device 22 (not shown in FIG. 2) may be used downstream of the spindle 26 in a manner such as shown in FIG. 1.

Figure 3:
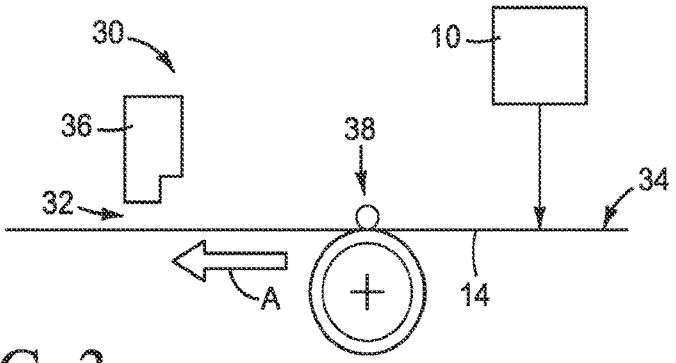
FIG. 3 is a schematic drawing, showing the relative position of the print pre-treatment modules depicted in FIGS. 1 and 2 in a printer, according to an example.

An example of a printing apparatus that incorporates the pre-treatment module 10 as disclosed herein is illustrated in FIG. 3. The example printing apparatus 30 may include a print zone 32, where a printing fluid may be deposited on the printing surface 34 of the print medium 14 from a printhead 36. Input rollers 38 may cause the advance of the print medium 14 towards the print zone 32, in a direction of print media advance shown by arrow A in FIG. 3.

According to examples disclosed herein, the pre-treatment module 10 may be provided in the apparatus before the print zone 32, i.e. upstream of the print zone, in the direction of print media advance A through the apparatus 30, so that the pre-treatment module 10 smears exudates on the printing surface 34 of the print medium 14 when the print medium is advanced towards the print zone 32 before printing.

The speed of the web of print medium 14 through the printing apparatus 30 may be the speed of the printer 30. It may be sufficient that the pre-treatment module 10 provides adequate smearing of the exudates on the print medium 14. The conditions for ensuring adequate smearing have been discussed above.

In an ideal case, 100% reduction in the number of defects or inhomogeneities in the printed image may be desired. However, even a substantial reduction may be considered to provide an acceptable printed image. What determines a substantial reduction in the number of defects to provide an acceptable image may be a subjective determination.

Figure 4:
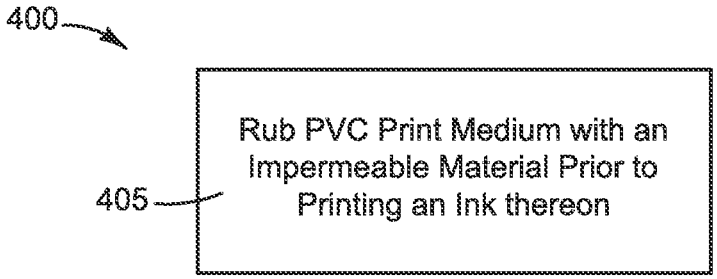
FIG. 4 depicts a method for reducing print defects on a PVC print medium, according to an example.

FIG. 4 depicts a method 400 for reducing print defects on a PVC print medium with exudates printed with an ink. The method 400 includes rubbing 405 the PVC print medium with an impermeable material prior to printing the ink thereon. The various conditions for rubbing the PVC print medium 14 with the impermeable material 16 have been discussed above.

FIGS. 5A-5B and 6A-6B illustrate the results of printing PVC print media without (FIGS. 5A-5B) and with (FIGS. 6A-6B) a pre-treatment step. In both cases, a Latex 360 printer was used, with six passes of the printhead and settings for vinyl media.

Figure 5A:
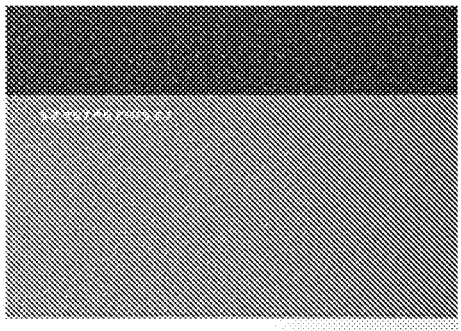
FIGS. 5A-5B are photomicrographs of print without pre-treatment, showing a grey printed area (FIG. 5A) and a black printed area (FIG. 5B).
Figure 5B:
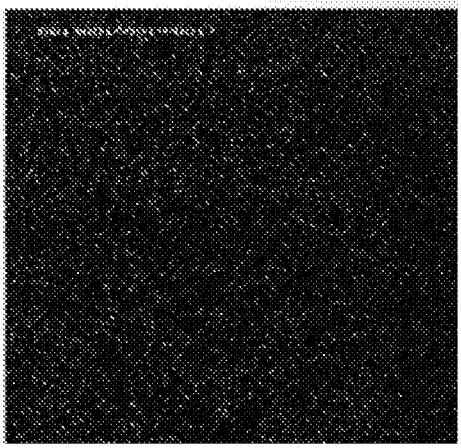

FIG. 5A shows a grey printed area, while FIG. 5B shows a black printed area. It will be seen that mottle appears in the gray print area and light spots, or defects, appear in the black printed area.

Figure 6A:
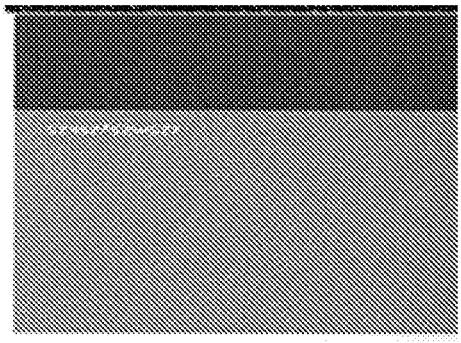
FIGS. 6A-6B are photomicrographs of print with pre-treatment, showing a grey printed area (FIG. 6A) and a black printed area (FIG. 6B), employing the print pre-treatment module similar to that depicted in FIG. 1, according to an example.
Figure 6B:
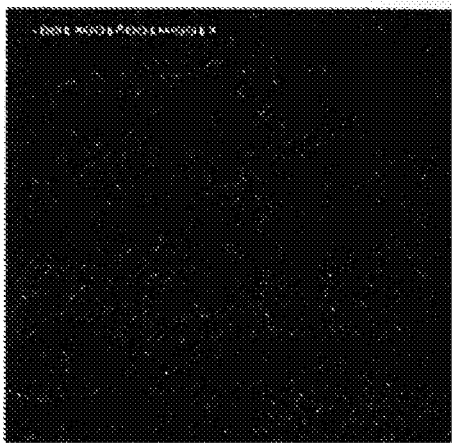

For FIGS. 6A-6B, the pre-treatment step involved the rubbing of some of the unprinted PVC media on itself prior to printing in order to smear out the exudates that may have been present on the surface prior to printing, similar to the pre-treatment module 10 depicted in FIG. 1. The results are shown in FIG. 6A (grey printed area, like FIG. 5A) and FIG. 6B (black printed area, like FIG. 5B). It will be seen that the mottle in the grey print area and the light spots in the black printed area are greatly reduced or eliminated.

It appears that the use of an impermeable material to smear plasticizers and other exudates on the vinyl media may allow the inks to more uniformly wet the surface. Rather than removing the exudates from the vinyl surface, which would require absorptive rollers that would have to be changed out or dealt with as potentially hazardous materials, the use of the impermeable material in rubbing contact with the vinyl surface may greatly reduce or even eliminate altogether any need to switch out and replace the impermeable material.

The invention claimed is:

1. A prim pre-treatment module for pre-treating a polyvinyl chloride (PVC) print medium prior to printing an ink on the PVC print medium from a primer, the PVC print medium having exudates on its surface, the module including:

an impermeable material in rubbing contact with the PVC print medium, which is supported on a media roller conveying the PVC print medium, wherein the impermeable material is draped over the media roller and maintained in tension to form a drape in rubbing contact with the PVC print medium.

2. The print pre-treatment module of claim 1 wherein the ink is a latex ink or an eco-solvent ink.

3. The print pre-treatment module of claim 1 wherein the impermeable material is maintained in tension by a weight.

4. The print pre-treatment module of claim 1 wherein the impermeable material is maintained in tension by a spring mechanism.

5. The print pre-treatment module of claim 1 wherein the impermeable material is wrapped around a spindle and is to freely counter-rotate against the PVC print medium in rubbing contact.

6. The print pre-treatment module of claim 1 further including a static dissipation device downstream of the print pre-treatment module to reduce or eliminate any static built up during treatment.

7. The print pre-treatment module of claim 1 wherein the impermeable material comprises a non-woven polymer sheet.

8. The print pre-treatment module of claim 7 wherein the non-woven polymer sheet comprises a material selected from the group consisting of PVC or other vinyl material, low density polyethylene film (LDPE), high density polyethylene film (HDPE), and polyethylene terephthalate film (PET).

9. A printer for printing an ink on a PVC print medium, the printer including a print zone in which the ink is printed on the PVC print medium, the printer further including the print pre-treatment module of claim 1, located upstream of the print zone.

10. A method for reducing print defects on a PVC print medium with exudates printed with an ink, comprising:

rubbing the PVC print medium with an impermeable material prior to printing the ink thereon, wherein the impermeable material is draped over a media roller and maintained in tension to form a drape in rubbing contact.

11. The method of claim 10 wherein the ink is a latex ink or an eco-solvent ink.

12. The method of claim 10 wherein the impermeable material is wrapped around a spindle and is to freely counter-rotate against the print medium in rubbing contact.

13. The method of claim 10 further including subjecting the print medium to static dissipation downstream of the impermeable material to reduce or eliminate any static built up during treatment.

14. The method of claim 10 wherein the impermeable material is maintained in tension by a weight.

15. The method of claim 10 wherein the impermeable material is maintained in tension by a spring mechanism.

16. The method of claim 10 wherein the impermeable material comprises a non-woven polymer sheet comprising a material selected from the group consisting of polyvinyl chloride (PVC) or other vinyl material, low density polyethylene film (LDPE), high density polyethylene film (HDPE), and polyethylene terephthalate film (PET).

* * * * *